US009987601B2

(12) United States Patent
Cheng

(10) Patent No.: US 9,987,601 B2
(45) Date of Patent: Jun. 5, 2018

(54) AERATOR DEVICE FOR, AND METHOD OF, AERATING A DRINKABLE LIQUID

(71) Applicant: Peter Shu-Chun Cheng, Hong Kong SAR (CN)

(72) Inventor: Peter Shu-Chun Cheng, Hong Kong SAR (CN)

( * ) Notice: Subject to any disclaimer, the term of this patent is extended or adjusted under 35 U.S.C. 154(b) by 217 days.

(21) Appl. No.: 15/077,974

(22) Filed: Mar. 23, 2016

(65) Prior Publication Data

US 2017/0274330 A1 Sep. 28, 2017

(51) Int. Cl.

| | |
|---|---|
| ***B01F 3/04*** | (2006.01) |
| ***B01F 5/06*** | (2006.01) |
| ***B01F 15/00*** | (2006.01) |
| ***A47G 19/22*** | (2006.01) |

(52) U.S. Cl.

CPC ..... *B01F 3/04794* (2013.01); *A47G 19/22* (2013.01); *B01F 5/0606* (2013.01); *B01F 15/00512* (2013.01); *B01F 15/00662* (2013.01); *B01F 15/00733* (2013.01); *B01F 15/00896* (2013.01); *A47G 2400/045* (2013.01); *B01F 2003/04872* (2013.01); *B01F 2215/007* (2013.01); *B01F 2215/0022* (2013.01); *B01F 2215/0072* (2013.01)

(58) Field of Classification Search

CPC ..... B01F 3/04794; B01F 15/00733; B01F 15/00896; B01F 15/00662; B01F 15/00512; B01F 5/0606; B01F 2003/04872; B01F 2215/0072; B01F 2215/007; B01F 2215/0022; A47G 19/22; A47G 2400/045

See application file for complete search history.

(56) References Cited

U.S. PATENT DOCUMENTS 395,303 A * 12/1888 Wuchner ..... B01F 13/002 366/130

510,835 A 12/1893 Blair (Continued)

FOREIGN PATENT DOCUMENTS

| | | |
|---|---|---|
| CH | 699332 | 2/2010 |
| DE | 60112533 | 6/2006 |

(Continued)

OTHER PUBLICATIONS

Machine translation of Dayer WO 2008/014625 A1 published Feb. 2008 (Year: 2008).*

(Continued)

*Primary Examiner* — Amber R Orlando
*Assistant Examiner* — Stephen Hobson
(74) *Attorney, Agent, or Firm* — Kirschstein, Israel, Schiffmiller & Pieroni, P.C.

(57) ABSTRACT

A device aerates a drinkable liquid inside a handheld container. An aerator is detachably mounted on the container in a mounted position. The aerator has an aerator portion that extends into the liquid and that is held adjacent an interior surface of a side wall of the container in the mounted position. The aerator portion has a multitude of turbulence-inducing agitating elements, such as pores, through which the liquid in the container flows to, and impacts against, the interior surface of the side wall of the container, and mixes with ambient air in the container, when the container is manually swirled to aerate the liquid.

14 Claims, 4 Drawing Sheets

(56) References Cited

U.S. PATENT DOCUMENTS

| | | | | | |
|---|---|---|---|---|---|
| 1,060,419 | A * | 4/1913 | Benjamin | B01F 7/00408 | 366/130 |
| 1,076,702 | A | 10/1913 | Rich | | |
| 1,188,147 | A | 6/1916 | Butler | | |
| 4,483,622 | A * | 11/1984 | Muhi | A47G 19/22 | 366/129 |
| 5,857,584 | A * | 1/1999 | Taggart | A47G 19/2211 | 220/23.9 |
| 7,188,743 | B1 * | 3/2007 | Gates | A47G 19/2205 | 215/389 |
| 2009/0212053 | A1 * | 8/2009 | Lardino | A47G 19/2205 | 220/62.12 |
| 2011/0297001 | A1 * | 12/2011 | DeJohn | B01F 3/04744 | 99/277.2 |
| 2014/0367398 | A1 * | 12/2014 | Ellsbury | A47G 19/2227 | 220/694 |

FOREIGN PATENT DOCUMENTS

| | | | | |
|---|---|---|---|---|
| EP | 1210890 | A1 * | 6/2002 | A47G 19/2205 |
| WO | 2008014625 | | 2/2008 | |
| WO | WO 2008/014625 | A1 * | 2/2008 | |

OTHER PUBLICATIONS

Extended European Search Report in corresponding European application No. 17150591.0, dated Aug. 1, 2017.

* cited by examiner

FIG. 4
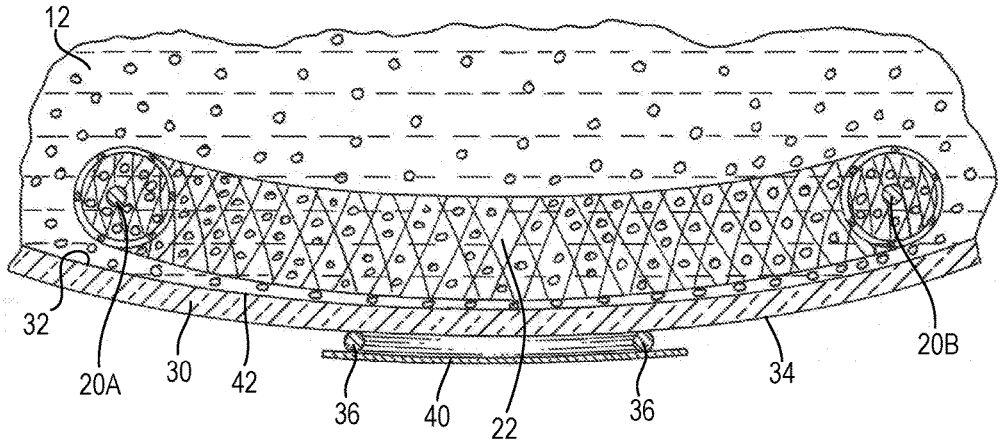
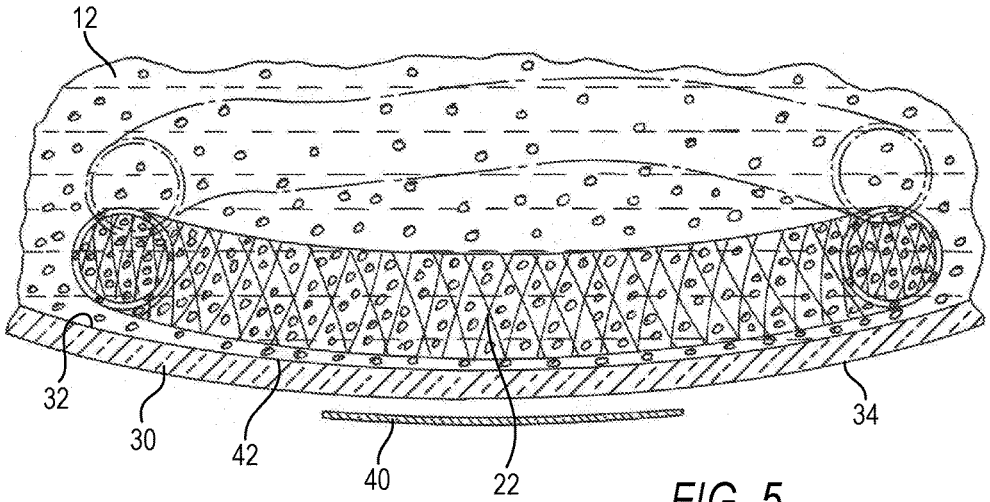
FIG. 5

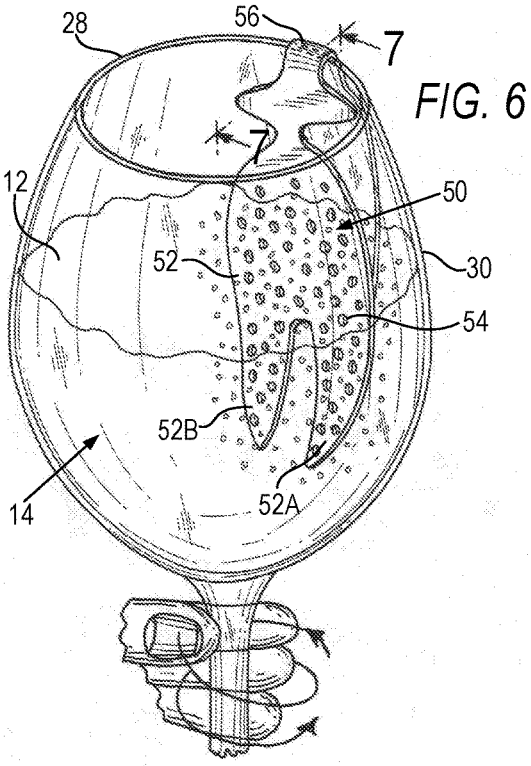
FIG. 6
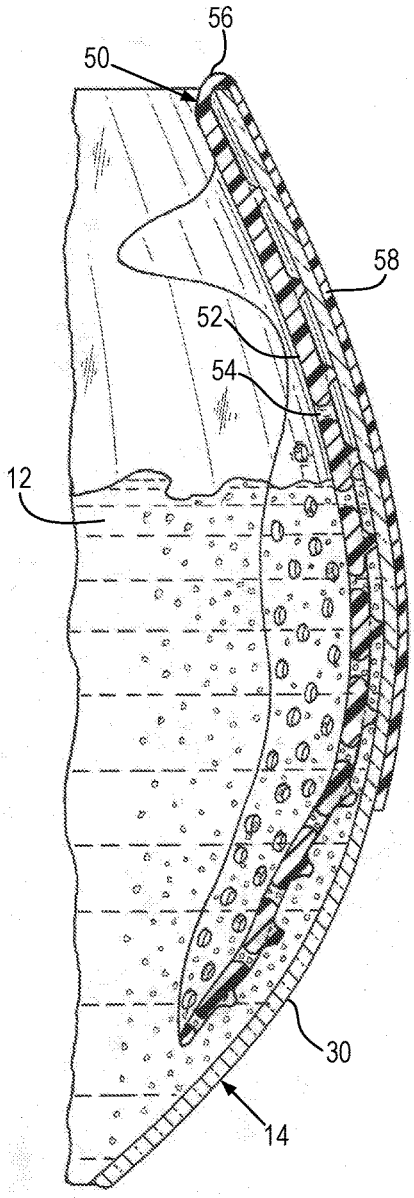
FIG. 7
FIG. 8
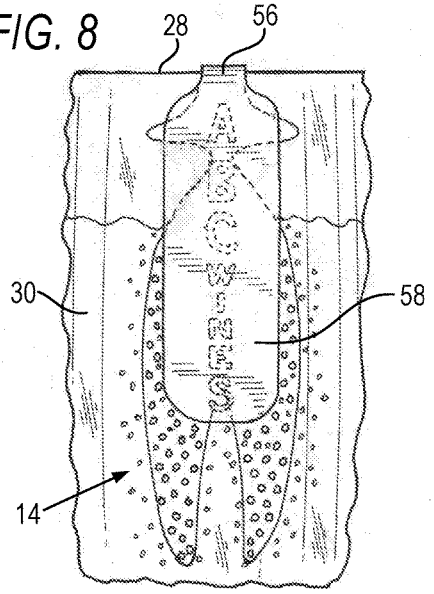

AERATOR DEVICE FOR, AND METHOD OF, AERATING A DRINKABLE LIQUID

FIELD OF THE DISCLOSURE

The present disclosure relates generally to an aerator device for, and to a method of, aerating a drinkable liquid in a handheld container.

BACKGROUND

Aeration of liquids is a process by which ambient air is circulated through, mixed with, and/or dissolved in, a liquid. Drinkable liquids, such as wine, whiskey, sake, tea, or the like, benefit from being aerated. For example, in wine tasting, many methods are used to aerate wine to trigger oxidation and evaporation to better bring out the wine aroma or bouquet, including by swirling the wine in a glass, sometimes modified and integrated with internal ridges to enhance the aeration, or by using a decanter to increase exposure of the wine to ambient air, or by simply waiting a sufficient time for the wine to breathe, or by employing specialized wine aerator devices to mix ambient air into the wine. Injection-style aerator devices work by the Venturi effect and Bernoulli's principle, and typically feature a funnel or wide tube that narrows. Decanter-top aerator devices have been used for aeration, and sieve-style decanter-top funnels have also been used for aeration and for catching sediment. Boxed wine and vacuum-sealed wine can be aerated through the use of single glass aerating devices, some of which have movable spouts that adjust to different sizes and shapes of wine glasses.

Yet, despite the many styles of such aerator devices, full wine aeration tends to take a long time, and a single aerator device is not suitable for all types of wines and for all kinds of drinkers. Different individual drinkers often wish to drink wine, even from the same wine bottle, at different levels of aeration, and to pace themselves as to when to drink at different times, from other drinkers. As a result, multiple aerator devices, each suited for a particular wine and/or for a particular drinker, are sometimes employed, which is typically beyond what is necessary or appropriate for most drinkers. In addition, specially modified wine glasses with internal ridges are often not available for use, particularly outside the home of a wine enthusiast.

Accordingly, there is a need to provide a universal aerator device that can quickly achieve a full aeration, that can be customized for individual drinkers, that can be used for aerating a wide variety of different types of drinkable liquids, that does not require specially modified glasses, and that can be readily cleaned and re-cased.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIG. 4 is an enlarged, sectional view taken on line 4-4 of FIG. 1.

FIG. 5 is an enlarged, sectional view taken on line 5-5 of FIG. 1.

FIG. 6 is a perspective view of another embodiment of an aerator device mounted on a broken-away, handheld container in accordance with this invention.

FIG. 7 is a sectional view taken on line 7-7 of FIG. 6.

FIG. 8 is an exterior side view of the embodiment of FIG. 6.

Figure 1:
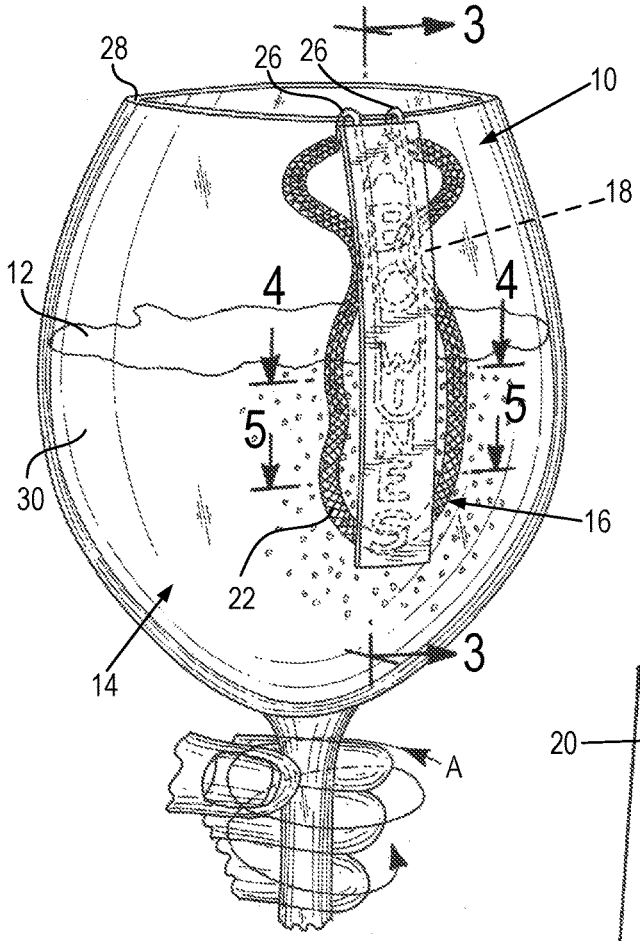
FIG. 1 is a perspective view of one embodiment of an aerator device mounted on a broken-away, handheld container during manual swirling of the container and aeration of a drinkable liquid therein in accordance with this invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The structural and method components have been represented where appropriate by conventional symbols in the drawings, showing only those specific details that are pertinent to understanding the embodiments of the present invention so as not to obscure the invention with details that will be readily apparent to those of ordinary skill in the art having the benefit of the description herein.

DETAILED DESCRIPTION

In accordance with one feature of this disclosure, a device for aerating a drinkable liquid, such as wine, whiskey, sake, tea, or the like, inside a handheld container, such as a glass, includes an aerator detachably mounted on the container in a mounted position. The aerator has an aerator portion extending into the liquid and held adjacent an interior surface of a side wall of the container in the mounted position. The aerator portion has a multitude of agitating elements for inducing turbulence in the liquid to aerate the liquid when the container is manually swirled. The aerator portion may be a porous, molded plastic member, or a porous, tubular sheath. The liquid in the container flows through pores in the porous member or sheath to, and impacts against, the interior surface of the side wall of the container, and mixes with ambient air in the container, when the container is manually swirled to aerate the liquid. The aerator portion preferably remains inside the container during drinking of the liquid.

In accordance with another feature of this disclosure, a method of aerating a drinkable liquid, is performed by pouring the liquid into a handheld container having a side wall, by detachably mounting an aerator on the container in a mounted position, by inserting an aerator portion of the aerator into the liquid, by holding the aerator portion adjacent an interior surface of the side wall of the container in the mounted position, by configuring the aerator portion with a multitude of agitating elements, and by manually swirling the container to cause the agitating elements to induce turbulence in the liquid to aerate the liquid.

Thus, in accordance with this disclosure, the drinkable liquid is aerated more rapidly as compared to a conventional decanter. Now, individual drinkers, even those who are drinking from the same source of the liquid, can customize how rapidly to aerate their drinks, and can pace their drinking as compared to other drinkers. No longer are all drinks from the same source, e.g., a wine bottle, aerated to the same extent, as is the case with a conventional wine decanter. The aerating device disclosed herein is typically left on one's glass during drinking, during which time the aeration can be refreshed by repeatedly manually swirling the container. When the drinker is finished drinking, the aerating device disclosed is readily demounted and detached from the container and is readily cleanable, for example, by rinsing by hand with water or in a dishwasher, and is re-usable.

Turning now to the drawings, reference numeral 10 in FIG. 1 generally identifies one embodiment of a device for aerating a drinkable liquid 12 in a handheld container 14. In a preferred embodiment, the liquid 12 is wine, and the container 14 is a conventional, unmodified, wine glass, preferably stemware. Drinkable liquids, other than wine, both alcoholic and non-alcoholic, such as whiskey, sake and tea, are contemplated for use with this invention, as are other containers that have no stems. As illustrated in FIGS, 1-5, the aerating device 10 is detachably mounted on the container 14, and includes a holder having an interior holder portion 16 that is positioned inside the container 14, and an exterior holder portion 18 that is positioned outside the container 14, when the device 10 is mounted on the container 14. The holder is preferably a clip, but can be any type of holder, such as a clasp or analogous gripper or fastener, or even an annular resilient loop that is inserted entirely into the container 14 and is resiliently held therein by pressing against the interior circumferential surface of the container 14.

In the embodiment of FIGS. 1-5, the interior and exterior holder portions 16, 18 have a common flexible, bendable, deformable, wire 20 (see FIG. 2), typically made of a metal material, a plastic material, a plastic-coated metal material, or a like material that substantially maintains its shape after being bent. An aerator portion, preferably configured as a porous, flexible. U-shaped, tubular sheath 22 is mounted on the interior holder portion 16. The wire 20 has elongated opposite ends 20A, 20B that at least partly extend through the sheath 22. The opposite ends 20A, 20B of the wire 20 do not extend entirely through the sheath, and leave the lower part of the sheath 22 unsupported and free to move, as diagrammatically shown by the phantom lines in FIGS. 3 and 5. The sheath 22 is preferably a mesh of fabric material and has a multitude of pores 24. The wire 20 has bends 26 between the interior and exterior holder portions 16, 18. Each bend 26 overlies, and rests on, a rim 28 of the container 14 when the device 10 is mounted on the container 14.

Figure 3:
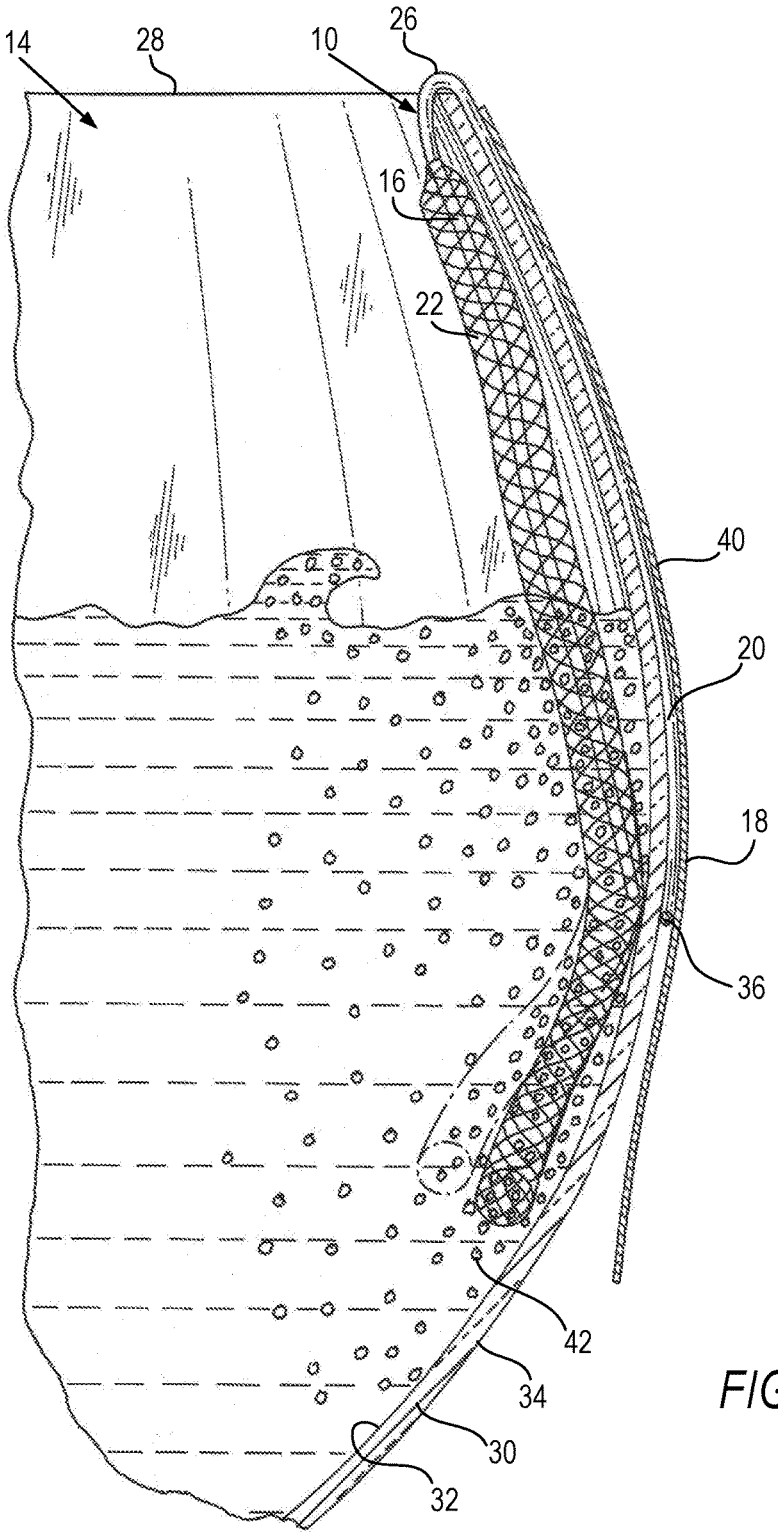
FIG. 3 is an enlarged, sectional view taken on line 3-3 of FIG. 1.

After the device 10 has been mounted on the container 14, the wire 20 and the sheath. 22 are deformed to generally conform to, and to extend at least partly along an interior surface 32 of, a side wall 30 of the container 14. Typically, the wire 20 and the sheath 22 are pressed against the side wall 30 prior to pouring the liquid 12 into the container 14. Thus, if the side wall 30 is spherically curved, as shown in FIG. 3, then the wire 20 and the sheath 22 are similarly pressed and deformed in situ and spherically curved to generally lie closely adjacent, and at a spacing away from, the interior surface 32 of the curved side wall 30. The exterior holder portion 18 resiliently and tightly presses against an exterior surface 34 of the side wall 30 to hold the holder in its mounted position.

Figure 2:
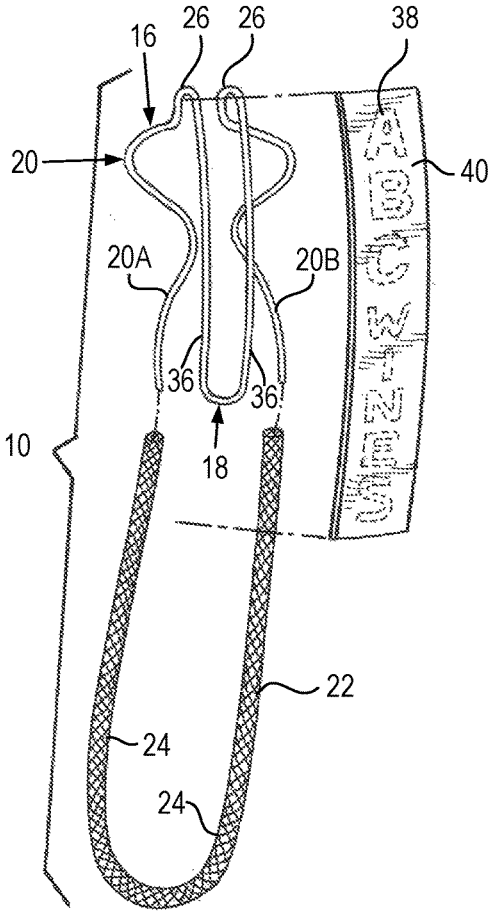
FIG. 2 is an exploded, perspective view of the embodiment of FIG. 1.

As shown in FIGS. 1-2, the wire 20 of the interior holder portion 16 has an hourglass configuration, in which a pair of wire portions converge to a waist and diverge away from the waist. The wire 20 of the exterior holder portion 18 has a pair of legs 36 that may or may not be interconnected. The exterior holder portion 18 preferably has a plate 40 bearing indicia 38 for attracting attention, such as a logo, a graphic, an adornment, or an advertising message.

After the device 10 has been mounted on the container 14, the liquid 12 can be poured therein up to a level at which the sheath 22 is at least partly immersed in the liquid 12. The container 14 can also contain the liquid 12 prior to the mounting of the device 10. To aerate the liquid 12, the container 14 is manually swirled in the circular direction of arrow A in FIG. 1. This action causes the liquid 12 in the container 14 to flow through the pores 24, to impact against the side wall 30, to break up, to mix with ambient air in the container 14, and to form air bubbles 42. The pores 24 serve as agitating elements for inducing turbulence in the liquid 12 during such swirling. The unsupported bottom of the sheath 22 is also free to move to act as an additional agitator. The sheath 22 preferably remains inside the container 14 during drinking of the liquid 12. The hourglass shape of the wires of the interior holder portion 16 helps to direct the liquid 12, after being swirled, downwardly along the interior surface 32 of the side wall 30.

The aerating device 10 is typically left on or in the container 14 during drinking, during which time the aeration can be refreshed by repeatedly manually swirling the container 14. When a drinker is finished drinking, the aerating device 10 is readily detached from the container 14 and is readily cleanable, for example, by rinsing by hand with water or in a dishwasher, and is re-usable.

FIGS. 6-8 depict another embodiment of the aerating device, and like reference numerals have been employed to identify like parts. Instead of the two-part construction of the embodiment of FIGS. 1-5, the embodiment of FIGS. 6-8 is of a one-piece construction and comprises a single, molded plastic, aerator 50 that is detachably mounted on the container 14 in a mounted position. The aerator 50 has an aerator portion 52 that extends into the liquid 12 and is held adjacent the interior surface 32 of the side wall 30 of the container 14 in the mounted position. The aerator portion 52 has a multitude of pores 54 through which the liquid 12 in the container 14 flows to, and impacts against, the interior surface 32 of the side wall 30 of the container 14, and mixes with ambient air in the container 14, when the container 14 is manually swirled to aerate the liquid 12. As described above, the pores 54 serve as agitating elements for inducing turbulence in the liquid 12 during such swirling The aerator 50 has a clip portion 56 that clips on the rim 28 of the container 14 in the mounted position. The clip portion 56 has an extension part 58 that extends along, and is held against, the exterior surface 34 of the side wall 30 of the container 14 in the mounted position. As before, indicia 38 is provided on the extension part 58 for attracting attention. The aerator portion 52 is flexible and deformable to generally conform to, and to extend at least partly along, the interior surface 32 of the side wall 30 of the container 14 in the mounted position. For increased flexibility, the aerator portion 52 includes a pair of flexible, deformable leg parts 52A, 52B. Each of the leg parts 52A, 52B may be provided with spacers for engaging the interior surface 32 of the side wall 30 of the container 14, and for spacing the leg parts 52A, 52B at a spacing away from the interior surface 32 in the mounted position. As before, the aerator portion 52 has an hourglass configuration that converges to a waist and diverges away from the waist.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structurethat is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A device for aerating a drinkable liquid inside a handheld container, the device comprising:

an aerator detachably mountable on the container in a mounted position, the aerator having an aerator portion extending into the liquid and held adjacent an interior surface of a side wall of the container in the mounted position, the aerator portion having a multitude of pores and a hollow, tubular sheath through which the pores extend, the aerator portion including a bendable wire holder that extends into an interior of the sheath and holds the sheath adjacent the interior surface of the side wall of the container in the mounted position for inducing turbulence in the liquid to aerate the liquid when the container is manually swirled.

2. The device of claim 1, wherein the aerator has a clip portion that clips on a rim of the container in the mounted position.

3. The device of claim 2, wherein the clip portion has an extension part that extends along, and is held against, an exterior surface of the side wall of the container in the mounted position.

4. The device of claim 3, and indicia on the extension part for attracting attention.

5. The device of claim 1, wherein the aerator portion is flexible and deformable to generally conform to, and to extend at least partly along and adjacent, the interior surface of the side wall of the container in the mounted position.

6. The device of claim 1, wherein the aerator portion is spaced away from the interior surface of the side wall of the container, and wherein the liquid in the container flows through the pores to, and impacts against, the interior surface of the side wall of the container, and mixes with ambient air in the container, when the container is manually swirled to aerate the liquid.

7. The device of claim 1, wherein the aerator portion has an hourglass configuration that converges to a waist and diverges away from the waist.

8. A method of aerating a drinkable liquid, the method comprising:

pouring the liquid into a handheld container having a side wall;

detachably mounting an aerator on the container in a mounted position;

inserting an aerator portion of the aerator into the liquid;

holding the aerator portion adjacent an interior surface of the side wall of the container in the mounted position;

configuring the aerator portion with a multitude of pores, with a hollow, tubular sheath through which the pores extend, and with a bendable wire holder that extends into an interior of the sheath and holds the sheath adjacent the interior surface of the side wall of the container in the mounted position; and manually swirling the container to cause the pores to induce turbulence in the liquid to aerate the liquid.

9. The method of claim 8, and clipping the aerator on a rim of the container in the mounted position.

10. The method of claim 9, and configuring the clip portion with an extension part that extends along, and is held against, an exterior surface of the side wall of the container in the mounted position.

11. The method of claim 10, and applying indicia on the extension part for attracting attention.

12. The method of claim 8, and deforming the aerator portion to generally conform to, and to extend at least partly along and adjacent, the interior surface of the side wall of the container in the mounted position.

13. The method of claim 8, and spacing the aerator portion away from the interior surface of the side wall of the container, and configuring the pores through which the liquid in the container flows to impact against the interior surface of the side wall of the container, and mix with ambient air in the container, when the container is manually swirled to aerate the liquid.

14. The method of claim 8, and configuring the aerator portion with an hourglass configuration that converges to a waist and diverges away from the waist.

* * * * *